US008235323B2

(12) United States Patent
Newton, Jr.

(10) Patent No.: US 8,235,323 B2
(45) Date of Patent: Aug. 7, 2012

(54) STORAGE REEL FOR ELECTRONIC CABLE

(76) Inventor: George P. Newton, Jr., Syracuse, NY (US)

( * ) Notice: Subject to any disclaimer, the term of this patent is extended or adjusted under 35 U.S.C. 154(b) by 330 days.

(21) Appl. No.: 12/767,234

(22) Filed: Apr. 26, 2010

(65) Prior Publication Data

US 2011/0259992 A1 Oct. 27, 2011

(51) Int. Cl.
*B65H 75/28* (2006.01)
*B65H 75/14* (2006.01)

(52) U.S. Cl. ..... 242/402; 242/405.1; 242/580; 242/587.3; 242/608.4; 242/614; 242/118.6; 242/125.3; 439/501

(58) Field of Classification Search ..... 242/164, 242/165, 172, 402, 405, 405.1, 476.1, 476.6, 242/579, 580–580.1, 585, 586, 587, 587.1, 242/587.2, 587.3, 588, 600, 607, 608, 608.2, 242/608.3, 608.4, 614, 118.4, 118.6, 125–125.3; 439/501

See application file for complete search history.

(56) References Cited

U.S. PATENT DOCUMENTS

| | | | | |
|---|---|---|---|---|
| 1,408,261 | A | 2/1922 | Brookhart | |
| 2,339,311 | A | 1/1944 | Young | |
| 2,952,420 | A | 9/1960 | Von Hoorn | |
| 4,177,961 | A | 12/1979 | Gruenewald | |
| D263,371 | S | 3/1982 | Allen | |
| D268,734 | S | 4/1983 | Soltes | |
| D301,834 | S | 6/1989 | Soltes | |
| 4,872,622 | A | 10/1989 | Mansfield | |
| D314,910 | S | 2/1991 | VanSkiver | |
| D359,440 | S | 6/1995 | Stewart | |
| D408,720 | S | 4/1999 | Sheng | |
| 5,992,787 | A | 11/1999 | Burke | |
| 6,783,093 | B2 | 8/2004 | Limber | |
| 7,434,761 | B2 | 10/2008 | Vogel et al. | |
| 2008/0164364 | A1 | 7/2008 | Kaltman | |
| 2012/0077372 | A1* | 3/2012 | Montena | 439/501 |

FOREIGN PATENT DOCUMENTS

| | | | |
|---|---|---|---|
| GB | 2306441 | A | 7/1997 |

* cited by examiner

*Primary Examiner* — William E Dondero
(74) *Attorney, Agent, or Firm* — Bernhard P. Molldrem, Jr.

(57) ABSTRACT

A reel for a microphone cable, amplifier cable or other electronic cord or cable has an arbor or hub that divides the reel into an interior space and a winding space. The cable leading end connector cable is retained in the interior space. Turns of the main body of the cable are coiled in the winding space. The rims of the reel side disks have annular retaining beads or ridges that face one another and create a snap connector holder for the trailing end connector. A gap in the retaining beads aligned with the arbor opening permits insertion of the leading end connector. The reel can be available in a range of sizes and can be color-coded. The reel can be constructed of two identical molded reel halves.

11 Claims, 4 Drawing Sheets

STORAGE REEL FOR ELECTRONIC CABLE

BACKGROUND OF THE INVENTION

This invention relates to portable reels and/or spools for storing, protecting, and transporting electrical and electronic cables and cords, such as microphone cables, speaker cables, and other wiring cables and cords for audio and video applications. The invention is more particularly concerned with improved design for reels used for winding, storing, and transporting cables of the type that have an elongated cable body and cable connectors at a leading end and at a trailing end. It is important that the cables be kept organized and un-tangled during set up, take down and transport, and that the cables, especially the connectors, be kept safe from possible damage e.g., from crushing or bending.

A need has long existed for a convenient, simple, and light-weight cable storage device, especially in portable audio work, e.g., in which numerous electrified musical or audio instruments such as guitars, microphones, amplifiers, and speakers need to be set up for a performance, and then quickly and efficiently taken down and packed up after a performance. Each of these items has at least one associated cable or cord, and these have to be unpacked and re-packed, properly identified, and kept free of damage. As of now, no existing spool, reel, or other cable storage device has been able to fulfill these objectives.

Numerous reels have been proposed for power cords, for garden hoses, for clotheslines or ropes, but none of these has been adapted for electronic cables and none would satisfy the objectives as mentioned just above.

OBJECTS AND SUMMARY OF THE INVENTION

Accordingly it is an object of this invention to provide a convenient and simple to use cable reel for winding, storing, transporting and unwinding electronic cables or cords such as microphone cords, guitar cords, amplifier cords and speaker cords.

It is a more particular object to construct the reel so that the winding of the cable can be easily started and so that the leading end connector and trailing end connector can be secured and protected from damage.

A further object is to construct the reel so that it does not require any separate components or any hinged or moving components.

It is another object to provide an improved cable reel that can be available in a range of sizes and colors, which will facilitate the storage, transport, and organization of a multitude of different sizes and types of cables and cords.

In accordance with one aspect of this invention, a cable reel of the type described herein is adapted for storage of an elongated flexible cable of the type having a connector at a leading end of the cable and a connector at a trailing end of the cable, where the connectors have a diameter greater than the diameter of the cable. The cable storage reel is formed of a pair of side disks positioned on a common axis, and spaced a predetermined distance apart, such that the side disks each have a center at the common axis and each also has a rim. A hub centered on the axis joins the pair of side disks. There is a generally cylindrical arbor disposed coaxially with the side disks, with the arbor defining a hollow, annular central space between the arbor and the axis or hub. The arbor also forms the inner limit of a cable winding space between the two disks, with the rims of the disks forming the radially outer limit. At the rim of one or both of said side disks, there is an annular retaining bead or ring that projects generally across (i.e., axially) toward the rim of the other disk. The retaining bead or beads form a retaining structure that is adapted to retain the training end connector when the associated cable has been wound up onto the reel.

The arbor is favorably provided with a connector opening dimensioned so that the leading end connector can pass through and reside in the annular central space in the hub of the reel. In a favorable embodiment this connector opening may be rounded and elongated, i.e., generally oval in shape. The opening may be tapered at each end to help capture the connector and aid in winding the cable. At least one retaining bead or beads at the rim of the side disk or disks may have a space or gap aligned with the connector opening. This gap permits passage of the leading end connector during winding or during unwinding of the cable.

In a preferred embodiment there are a pair of retaining beads disposed at the rim of each of said side disks, respectively. These form an outer ridge and a concentric inner ridge, with a generally annular hollow between them. The two retaining beads define a slot for passage of the flexible cable. The trailing end connector snaps in place in the hollows between the retaining beads at the disk rims. In some possible embodiments, a single rib or ridge may be used as the retaining bead. Also, the retaining structure may be present on only one side disk, or the arbor opening for the leading end connector may be offset to one side or the other.

The hub may also include a cylindrical or tubular core member disposed radially inward of the arbor.

A number of available materials may be employed in fabricating the cable storage reel of this invention. Preferably, the side disks are each formed of a resilient semi-rigid plastic resin material. The reels may be made in different colors for different types of cable, as well, to facilitate keeping track of the various cables. For example, amplifier cords reels may be red, speaker cable reels blue, guitar cord reels orange, etc.

These and many other objects, features, and advantages of the cable reel of this invention will become apparent from the ensuing detailed description of a preferred embodiment, when read in conjunction with the accompanying Drawing.

DETAILED DESCRIPTION OF THE PREFERRED EMBODIMENT(S)

Figure 1:
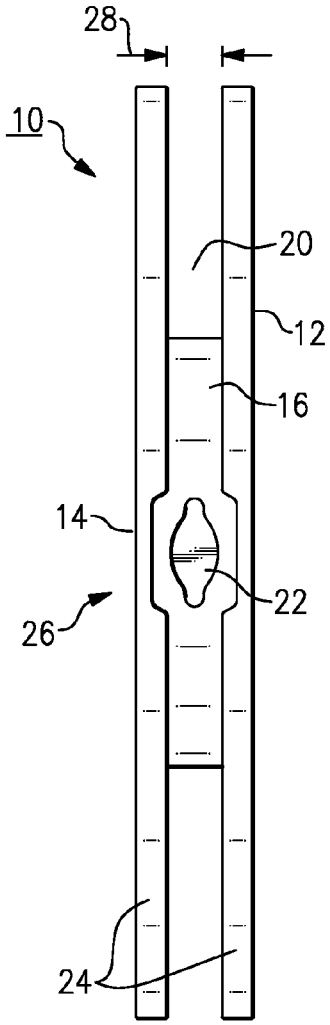
FIG. 1 is a perspective view of a reel for electrical or electronic cables according to one preferred embodiment of this invention.
Figure 2:
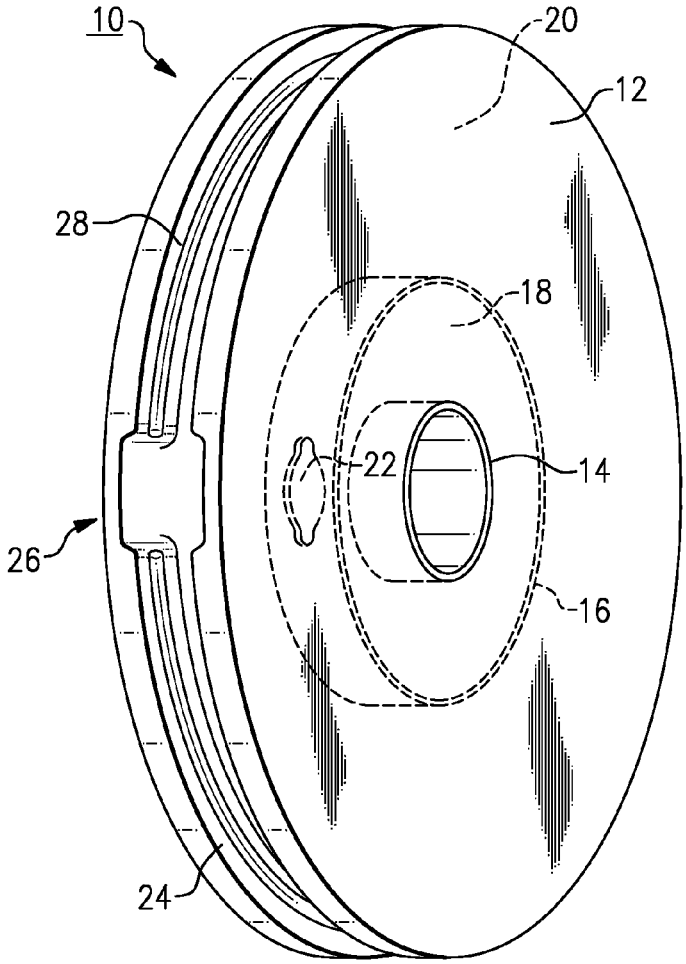
FIG. 2 is an edge-on elevation of the reel of this embodiment.

With reference to the Drawing, and initially to FIGS. 1 and 2, a cable reel 10 for winding an electronic cable for storage and/or for transit is shown as being formed of a pair of side disk members 12, 12 which are parallel and coaxial with one another, and are generally of the same dimension. The two disk members 12 are held together by a hub member or core 14, disposed at or near the center axis, and which may be a hollow, tubular core as shown. An outer hub member or arbor 16 in cylindrical form is disposed coaxially with the hub 14 and spaced radially out from it, so as to create an annular interior space 18 between the arbor 16 and the hub or core 14. This space 18 serves as region for the storage and protection for one of the cable connectors, as will be discussed later.

Between the two disks 12, 12, and extending radially out starting from the arbor 16 is a cable winding space 20 for accepting a number of turns of the flexible cable body. A generally round opening 22 through the arbor 16 is dimensioned to allow the leading end cable connector to be inserted into the space 18. At the inward side of each disk 12, and at or adjacent to the rim, is a ring or annular retaining bead 24. For each disk, the retaining bead continues around the rim of the disk, except for a gap 26 that is more or less aligned with the connector opening 22 of the arbor. The gap 26 is intended to permit the leading end connector to be inserted through into the winding space 20 and then through the opening 22. This gap also facilitates removal of the connector from the reel when the cable is being unwound from it. The two facing retaining beads 24 also create a slot 28 which is wide enough for the body of the cable, although slightly narrower than the diameter of the trailing end connector of the cable, so as to permit fairly easy winding up and unwinding.

In this preferred embodiment, as shown in FIGS. 3 to 6, the structure of the retaining beads takes the form of concentric inner and outer ridges 24*a*, 24*b*, with a generally annular hollow 24*c* being formed between them. These form a connector retainer feature in which the body of the trailing end connector is held in the hollows 24*c* of the two facing retaining beads.

Figure 4:
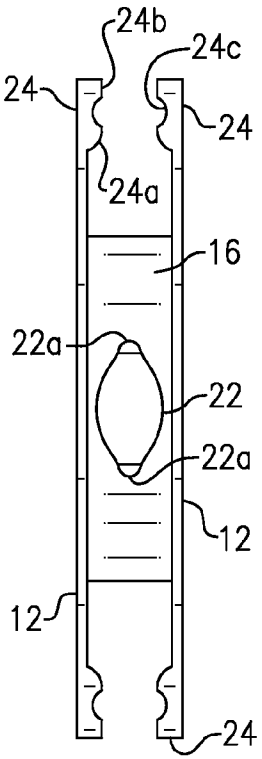
FIG. 4 is a cross section taken at line 4-4 of FIG. 3.
Figure 3:
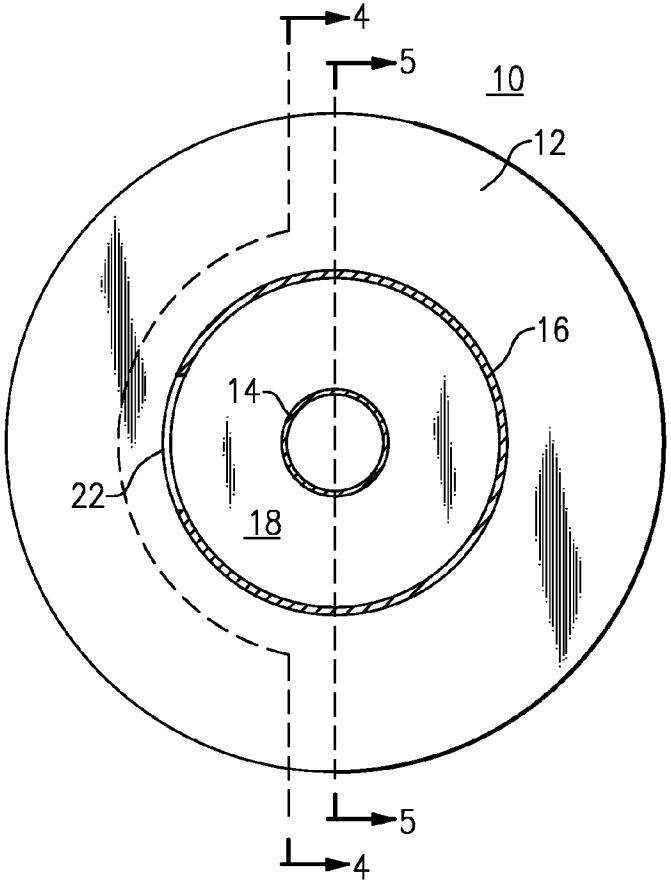
FIG. 3 is side elevation thereof.

Also, as shown in FIG. 4, the connector opening 22 in the arbor 16 is favorably of an elongated, rounded shape, that is, generally oval. In this embodiment, there are additional recesses 22*a* at the longitudinal ends of the opening 22. These are of a somewhat smaller diameter, and are intended more or less to match the size of the body of the cable or of the strain relief, so that the connector is held in place within the hollow interior space 18 when the cable is pulled to begin the winding process.

Figure 6:
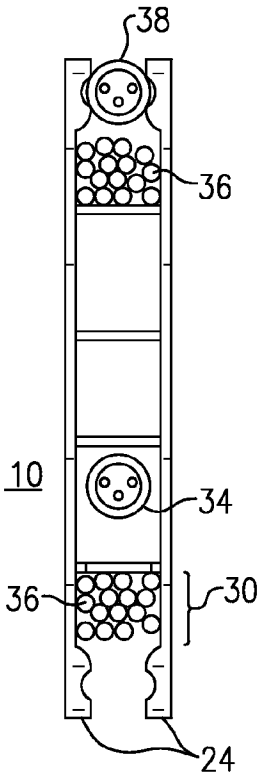
FIG. 6 is a cross section similar to FIG. 5 but showing the wound cable and end connectors in place on the reel.
Figure 5:
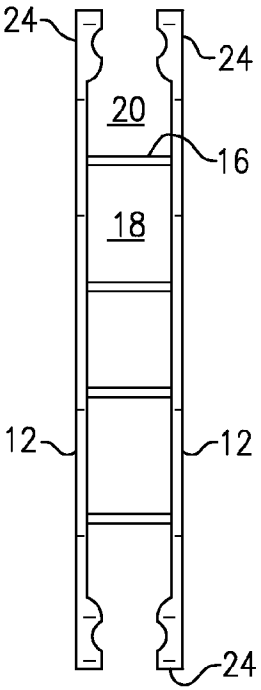
FIG. 5 is a cross section taken at line 5-5 of FIG. 3.

FIG. 6 shows generally the utility of the reel 10 in which a cable 30 is wrapped or wound into it. In this case, the cable has a first, or leading end connector 34 that is disposed in the interior space 18, and a body 36 of the elongated flexible cable is wound in multiple turns onto the arbor 16 in the winding space 20. At the end of the cable body is a trailing end connector 38 which snaps into place between the facing retaining beads 24. As shown here, the leading end and trailing end connectors 34 and 38 of are significantly greater diameter than the body 36 of the cable, and the arbor opening 22 and retaining beads 24, 24 are dimensioned to account for this.

Figure 7:
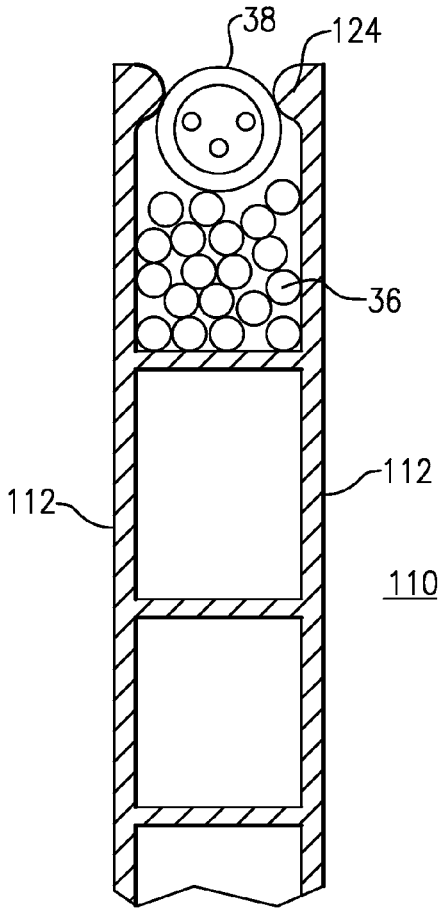
FIG. 7 is a partial cross section of an alternative embodiment.

One alternative construction of the cable reel of this invention is shown in cross section in FIG. 7. Here, elements that correspond to similar elements in the first embodiment are identified by similar reference numbers but raised by 100. The reel 110 is formed of a pair of disk members 112, 112 with hub and arbor as described previously. Here, the retaining beads 124 are formed of a simple ring or ridge that extends around the rim, although a gap may be present as described earlier. Here, the trailing end connector 38 of the cable is held snug by the retaining beads against the turns of the cable body 36.

Figure 8:
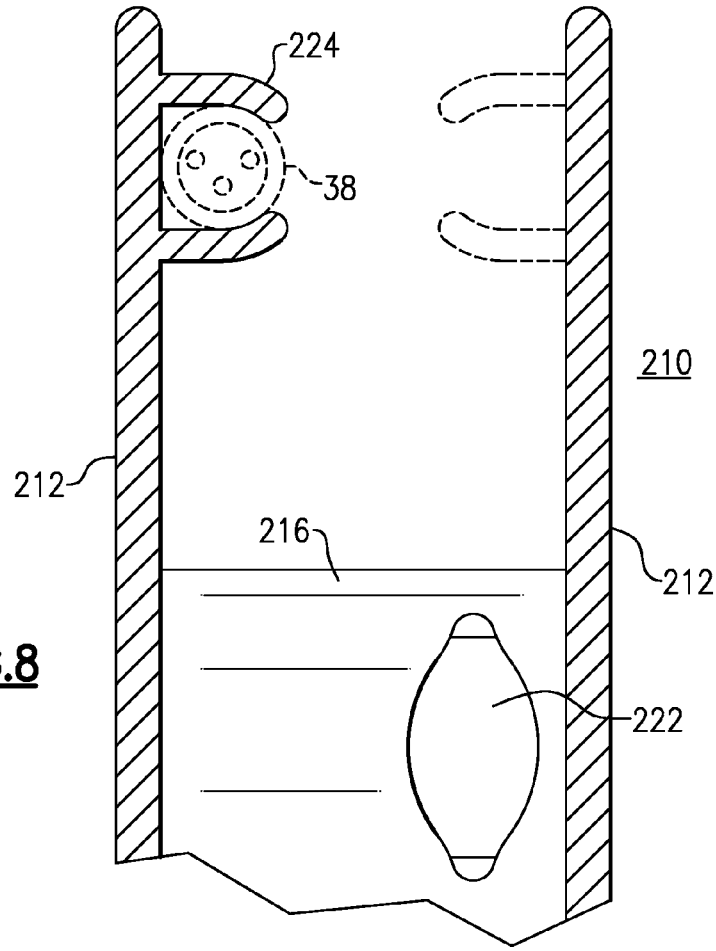
FIG. 8 is a partial cross section of another alternative embodiment.

A further embodiment is illustrated in FIG. 8, in which elements that are similar to those of the first embodiment are identified by similar reference numbers, but raised by 200. The reel 210 of this embodiment may be employed for an extended-length cord or cable. The arbor 216 is of greater axial extent than the earlier described embodiments, making the reel 210 wider with the side disks 212 are positioned farther apart. Here the arbor opening 222 for the leading end cable connector is offset to one side of the arbor 216. A snap-holder retaining member 224, which may extend entirely or partly around the rim, may be positioned on only one of the two disks 212. Alternatively, there may also be a retaining member on the other disk as well, as indicated in broken line.

Figure 9:
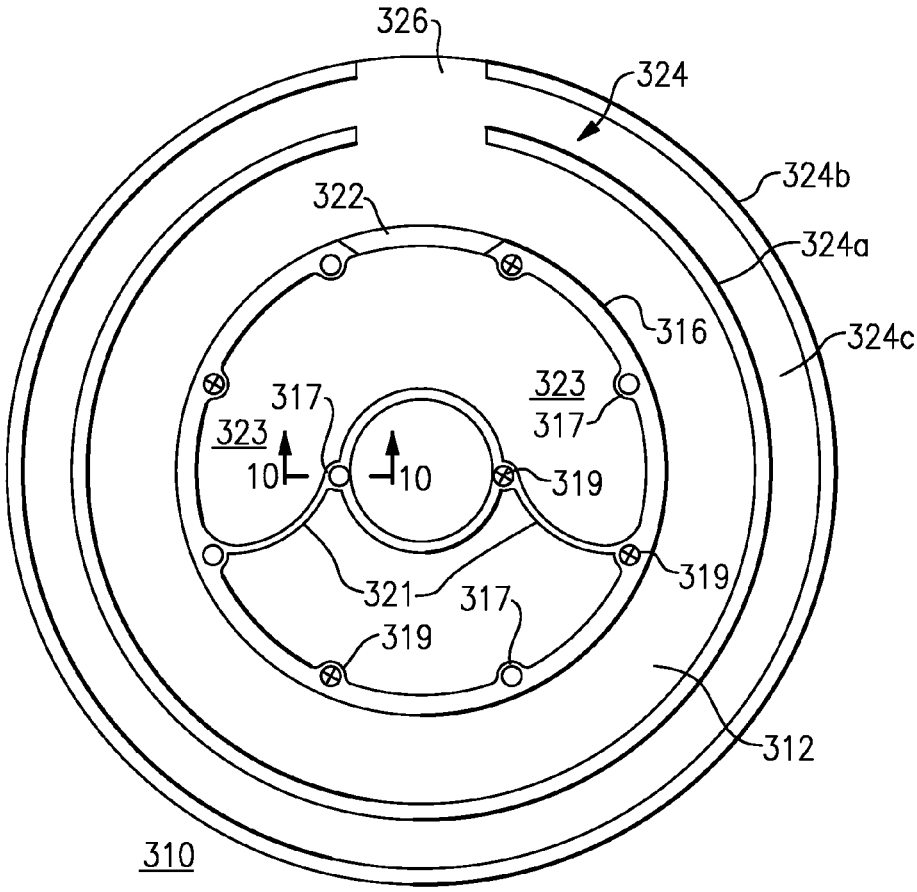
FIG. 9 is a mold profile of a cable reel of another embodiment.

FIG. 9 is a view showing a reel half according to one embodiment, which may be joined to a similar reel half to create a storage or transport reel for an electrical or electronic cord according to this invention. Here, elements that correspond to features of the first embodiment are identified with similar reference numbers but raised by 300. Each reel half 310 has a generally flat disk wall 312 with a generally cylindrical inner hub 314 and outer hub 316 that protrude axially. A gap 322 in the outer hub 316 serves to create the inner opening for the cable leading end connector. In this embodiment a curved wall 321 is molded into the annular space 318 between the inner and outer hubs, creating a double-ended C-shaped space 323, which in effect is a pair of pockets each being open at the gap 322. This construction allows the leading end connector to be inserted into either of the pockets, so that the cable may be wound in either a clockwise or counterclockwise direction. The retainer ridges 324 for the trailing end connector, with the associated gap 326, is shown at the rim of the disk wall 312.

Figure 10:
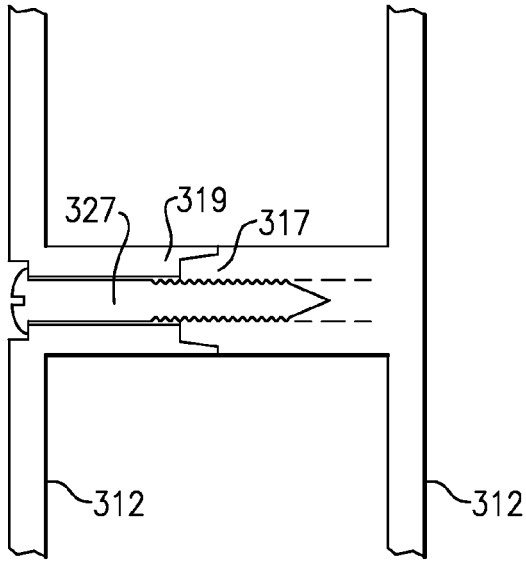
FIG. 10 is a sectional view taken at 10-10 of FIG. 9, to show the mating of two reel halves.

A pair of identical reel halves fasten to one another, as illustrated in FIG. 10. One or more male bosses 317, with screw fittings, and one or more female screw openings 319 are provided on the inner hub 314, and a plurality of male bosses 317 and female screw openings 319 are provided on the outer hub 316. These are distributed rotationally around the inner and outer hubs, and alternate between male boss 317 and female opening 319. The female openings 319 have smooth wall passages to receive the shank of a threaded fastener 327, and the male bosses 317 have threaded openings into which the screw threads of the fastener can mesh. When a pair of these reel halves are placed with the hub halves against each other, the male bosses 317 and female openings 319 respectively align so that screw fasteners 327, in the places shown, will hold the two reel halves securely together.

In this embodiment, only a single mold or die is needed, because two identical reel halves serve as the left and right sides of the same cable reel.

The side disks 12, 112, 212, 312 need not be true circular disks, but may in some cases be oblong or oval.

The invention is not limited to the foregoing embodiments, and many modifications and variations are possible without departing from the main concept. Rather the scope of this invention is defined in the appended claims.

I claim:

1. A reel for storage of an elongated flexible cable, the cable having a connector at a leading end of the cable and a connector at a trailing end of the cable, and wherein the connectors have a diameter greater than the diameter of the cable, the cable storage reel comprising a pair of side disks positioned on a common axis, and spaced a predetermined distance apart, the side disks each having a center at said common axis and a rim;

a hub joining the pair of side disks and including a generally cylindrical arbor disposed coaxially with said side disks, the arbor defining an annular central space between said arbor and said axis, and defining an outward winding space between said arbor and the rims of said disks; and at least one annular retaining bead disposed at the rim of one or both of said side disks, the retaining bead projecting axially toward the rim of the other of the pair of side disks, and defining a space adapted to retain the connector at the trailing end of the associated cable.

2. The cable storage reel of claim 1 wherein arbor includes a connector opening dimensioned for passage therethrough of the connector at the leading end of the associated cable.

3. The cable storage reel of claim 2 wherein said connector opening is generally oval in shape.

4. The cable storage reel of claim 2 wherein said at least one annular retaining bead includes a gap aligned with said connector opening.

5. The cable storage reel of claim 2 further comprising a wall formed within said annular central space, and forming an C-shaped void therein creating a pair of pockets that open at said connector opening.

6. The cable storage reel of claim 1 wherein said at least one retaining bead includes a pair of retaining beads disposed at the rim of each of said side disks, respectively.

7. The cable storage reel of claim 6 wherein each of said annular retaining beads includes a pair of concentric ridges on the rim of the respective one of said side disks.

8. The cable storage reel of claim 1 wherein said hub includes a cylindrical core member disposed radially inward of said arbor.

9. The cable storage reel of claim 1 wherein said side disks are each formed of a resilient semi-rigid plastic resin material.

10. The cable storage reel of claim 1 wherein said reel is formed of a pair of identical molded reel halves, including means fastening the reel halves together at the hub thereof.

11. The cable storage reel of claim 10 wherein said means fastening the reel halves includes male bosses and female openings formed on a hub portion of each reel half, and alternating with one another, the male bosses of each reel half being adapted to fit into the female opening of the other reel half.

* * * * *